United States Patent [19]

Trzeciak

[11] 4,199,201

[45] Apr. 22, 1980

[54] BEARING ASSEMBLY WITH ADJUSTABLE LOCK NUT

[75] Inventor: Kurt H. Trzeciak, Fountain Valley, Calif.

[73] Assignee: Smith International, Inc., Newport Beach, Calif.

[21] Appl. No.: 934,956

[22] Filed: Aug. 18, 1978

[51] Int. Cl.[2] ..... F16C 19/00

[52] U.S. Cl. ..... 308/8.2; 175/371; 308/230

[58] Field of Search ..... 308/8.2, 135, 189 A, 308/219, 227-231, 139; 175/371; 418/48

[56] References Cited

U.S. PATENT DOCUMENTS

| | | | |
|---|---|---|---|
| 3,879,094 | 4/1975 | Tschirky et al. | 308/230 |
| 4,029,368 | 6/1977 | Tschirky et al. | 308/135 X |

*Primary Examiner*—Douglas C. Butler

*Attorney, Agent, or Firm*—Philip Subkow; Bernard Kriegel; Newton H. Lee, Jr.

[57] ABSTRACT

An in-hole, fluid driven motor has a stator and a rotor to drive a bore hole drilling bit. The bit is connected to the rotor by a drive shaft rotatable in a bearing housing connected to the stator, and drilling fluid flows through the drive shaft and exits through the bit. Radial and thrust bearings include a first bearing which transmits thrust from the housing to the bit, while drilling, and a second bearing which transmits thrust to the housing from the shaft, when the bit is off the bottom of the hole. An adjustable lock nut is connected to the drive shaft and a ported cap which connects the drive shaft to a connecting rod coupled with the rotor, and permits alternate unloading of the first and second bearings and the elimination of increased bearing tolerances as wear occurs.

21 Claims, 9 Drawing Figures

BEARING ASSEMBLY WITH ADJUSTABLE LOCK NUT

In the drilling of bore holes, such as the drilling of bore holes into or through earth formation, such as, for example, the drilling of an oil or a gas well, it is well known to drive a rotary drill bit by an in-hole fluid driven motor, wherein the drilling fluid which is utilized to flush cuttings from the bore hole is the motor driving fluid. Drilling fluid is circulated downwardly through a string of drill pipe or conduit and flows through the stator of the in-hole motor to drive the rotor. The rotor is connected to the drilling bit by a drive shaft, and a portion of the drilling fluid may be employed to lubricate and cool the bearings during the drilling and circulating operations, as the bore hole progresses.

The drilling rate or the progression of the drill bit through the earth formation is dependent upon the application of axial thrust or load on the cutters. In the drilling of well bores, the drill pipe or conduit string includes heavy drill collars adapted to apply drilling weight to the bit. The weight is transmitted as thrust through the bearing assembly through thrust bearings which may be characterized as "set-down" bearings, in that the weight of the drill collars is transmitted to the drive shaft, and thus to the bit, through these bearings. Frequently, during the drilling operation, it is desirable or necessary to lift the drilling bit off of the bottom of the bore hole, while the circulation of drilling fluid is continued, to flush the bore hole clean. During circulation, the load is taken off the set-down bearings, and the drive shaft is supported on what may be characterized as "pick-up" bearings, as the drive shaft continues to rotate. The load on the pick-up bearings, during circulation, is determined by the weight of the rotor coupling, drive shaft and the bit, as well as by the differential pressure which acts across the rotor causing axial thrust.

Due to this piston effect, the thrust is substantial. Since the bearings, including the set-down bearings and the pick-up bearings, and any supplemental radial bearings between the drive shaft and the housing are, in many of such drilling tools, lubricated by the drilling fluid, a small quantity of which is allowed to circulate through the bearing assembly between the drive shaft and the housing, as a function of differential drilling fluid pressure across the bit orifices, the bearings are subjected to severe conditions of wear. The wear problem is very severe, inasmuch as the drilling fluid is laden with abrasive materials resulting from the recirculation of the drilling fluid after it returns to the top of the bore hole, carrying therein the cuttings resulting from the drilling operations.

Accordingly, it is known, as exemplified in the bearing construction illustrated in U.S. Pat. No. 4,029,368, granted June 14, 1977, to Tschirky and Crase, to incorporate in the structure a retaining means for the bearings, which affords a certain amount of clearance for the pick-up bearings, while the apparatus is effecting a drilling operation, and substantial thrust is being transmitted through the set-down bearings. Because of the clearance provided in the pick-up bearings, the pick-up bearings are allowed to idle, so to speak, since no thrust is transmitted therethrough, and as a result, the pick-up bearings do not wear as rapidly during the drilling operations as the wear would occur if the pick-up bearings were loaded. Thus the pick-up bearings are preserved to function under load during the substantial period of time that the apparatus may be picked up off the bottom of the hole, during the continued circulation of the drilling fluid.

Nevertheless, the problem has persisted, in that wear inevitably occurs in the set-down bearings and in the pick-up bearings, due to the errosive nature of the drilling fluid, and, over time, the bearing members may become so loose as to be incapable of continued functioning as bearing supports. For example, in the case of bearings comprising confronting races and balls, the ball races and balls may experience such wear, that when the drilling assembly is disposed at an angle within the bore hole, that is, during the drilling of a slanted bore hole, the balls may be so loose between the opposing races as to be capable of radial displacement from between the raceways.

The present invention provides a solution to the foregoing problem which involves the provision of means for providing a certain initial clearance for the pick-up bearing, when the apparatus is being operated to perform a drilling operation, with the bit on bottom of the hole and weight is transferred to the bit through the set-down bearings, wherein the means providing the clearance can be adjusted relative to the bearings, when the apparatus is removed from the bore hole, to reestablish a desired clearance, and take up the wear which has occurred between the bearing elements and the bearing races.

More particularly, the present invention provides an adjustable lock nut applicable to the cap which is applied to the drive shaft and forms a ported connector, whereby the rotor of the in-hole motor is connected to the drive shaft. The connector is ported to allow the drilling fluid to flow primarily from the motor stator into the hollow drive shaft, from which the drilling fluid exists through the bit orifices, entering the bore hole and returning to the top of the bore hole to flush cuttings therefrom.

In its simplest form, the invention provides a surface or abutment engageable by an upper race of the pick-up bearing when the bit is lifted off of the bottom of the hole, responsive to elevation of the drill pipe string and the motor and bearing housing, wherein the space between the stop surface and the lower race of the pick-up bearing can be adjusted to maintain the desired clearance over the operating life of the bearing assembly, so that the bearings need not necessarily be replaced when the drilling assembly is removed from the bore hole, say to change bits.

In another form, the invention provides an adjustable stop surface as described above, in combination with spring means incorporated in one or the other or both of the pick-up bearings and the set-down bearings, whereby both during drilling and during circulating with the bit off bottom, all of the bearing assemblies are maintained in spring loaded frictional contact, so that the respective balls and races cannot bounce, towards and away from one another during the respective drilling and circulating operations. With such a construction, as wear occurs, and the adjustable lock nut is adjusted to take up for wear, the spring elements are again preloaded to provide the desired frictional contact over a further range of wear. While spring loaded pick-up bearings are known, there has been no means for taking up wear or adjustably establishing the space containing the springs, to functing as described above.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Referring to the drawings:

FIG. 1 is a view partly in elevation and partly in vertical section illustrating an in-hole motor drilling apparatus incorporating the invention;

FIGS. *2a* and *2b*, together, constitute a longitudinal section, as taken on the line 2—2 of FIG. 1, on an enlarged scale, showng the bearing assembly of the invention, in the condition in which drilling load is being transferred through the bearing assembly to the bit, FIG. *2b* being a downward continuation of FIG. *2a;*

FIGS. *7a* and *7b*, together, constitute a longitudinal section corresponding to FIGS. *2a* and *2b*, showing a modified preferred form of the invention.

DESCRIPTION OF THE PREFERRED EMBODIMENT

Figure 1:
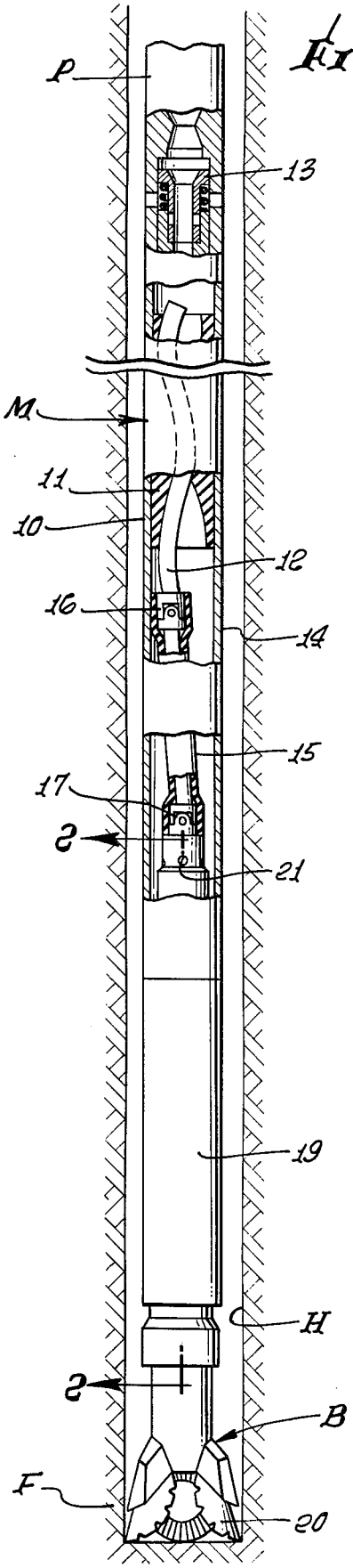

As seen in the drawings, referring first to FIG. 1, an in-hole motor assembly M is connected to the lower end of a string of drilling fluid conducting drill pipe P and has its housing 10 providing a progressing cavity stator 11 for a rotatable helicoidal rotor 12. The rotor is driven by the downward flow of drilling fluid from the pipe string through the usual dump valve 13, the fluid passing downwardly through a connecting rod housing section 14, which contains a connecting rod assembly 15, connected by a universal joint 16 to the lower end of the rotor 12 and by a universal joint 17 to the upper end of a drive shaft 18 (FIG. *2a*). The drive shaft extends downwardly through a bearing housing 19, and at its lower end, the drive shaft is connected to a drill bit B having cutters 20, adapted to drill through the earth formation F, in the drilling of a bore hole H.

The drive shaft 18 is tubular or hollow and has, adjacent its upper end, inlet ports 21, through which the drilling fluid passes from the connecting rod housing 14 into the elongated central bore 22 of the drive shaft, the fluid exiting from the bit B to flush cuttings from the bore hole and cool the bit.

During operation of the fluid motor M, the lower end of the rotor 12 has an eccentric motion which is transmitted to the drive shaft 18 by the universal connecting rod assembly 15, and the drive shaft 18 revolves about a fixed axis within the outer housing structure 23 of the bearing assembly 19, the drive shaft being supported within the housing, in accordance with the present invention, by bearing means, more particularly illustrated in FIGS. *2a* and *2b*.

The cutters 20 of the bit B drill through the earth formation, in the drilling of the bore hole, at a rate determined by the speed of rotation of the drive shaft 18 and the axial force or weight applied to the cutters through the intermediary of the bearing housing. In the case of certain earth formations, such as hard rock, the axial loading or force applied to the bit cutters is substantial, and therefore, the bearing means within the bearing assembly 19, through which the axial load is transferred from the housing 23 to the drive shaft 18, are subjected to severe axial loading, as well as to severe vibration and shock loading as the drill bit revolves on the bottom of the bore hole. In addition, the bearing means are subjected to severe radial loading, due to the high longitudinal force applied to the drive shaft, and, as is well known, the bearing assemblies utilized in connection with motor drills, such as that shown in FIG. 1, must, therefore, be very durable.

Since multiple thrust bearings are generally employed between such a bearing housing and drive shaft, it is difficult, and as a practical matter impossible, to provide a stacked bearing sub-assembly, without tolerances if the sub-assemblies are installed between thrust transmitting shoulders of fixed spacing. This is due to the fact that the components of the various bearing sub-assemblies, even though fairly precision made, nevertheless have manufacturing tolerances which cumulatively result in unequal loading of the bearings, unequal action of the springs when springs are employed, resulting in excessive wear and heat of friction in the case of the overloaded bearings and overworked springs. When it becomes necessary to service a bearing assembly, to replace, at least, the excessively worn and/or the excessively overworked bearings or springs, with new bearings or new springs, the cumulative tolerance problem is further aggravated, and, in some instances, it may even be necessary to replace the totality of the bearing sub-assemblies and springs to minimize the tolerance problem.

The present invention makes it possible to substantially eliminate the problems of excessive tolerance in the bearing sub-assemblies or units and of the cushioning spring action of the respective bearing units, and, thereby, eliminating the possibility of cumulative tolerance causing overload problems, such as loading of the pick-up bearings during drilling.

Referring to FIG. *2a*, it will be seen that the bearing housing structure 23 includes an elongated tubular housing pin end 25 engaged within the lower threaded box end 26 of the connecting rod housing 14. As seen in FIG. *2b*, the drive shaft 18 extends longitudinally through the housing assembly and has the bit B connected thereto by a threaded pin 28 in the box 29 in an enlarged lower end 30 projecting from the lower end of the housing. On the enlarged lower end of the drive shaft is an upwardly facting shoulder 30' which is axially opposed by a downwardly facing internal shoulder 31 provided within the lower end of the housing. Located between the opposed shoulders 30' and 31, within the annular space defined between the drive shaft and the inside of the housing, are lower thrust bearing means 32 adapted to transmit axial load or weight from the shoulder 31 to the shoulder 30' in the operation of the motor drill of FIG. 1 during drilling. The bearing means 32 is, thus, characterized as a "set-down" or drilling bearing.

Within the upper end of the bearing housing 23 is an upwardly facing end shoulder 33 opposed by adjustable lock nut means 34 which provides a downwardly facing shoulder, 35 opposing the upwardly facing shoulder 33. Between the shoulders 33 and 35 is a thrust bearing assembly 36 which is characterized as a pick-up bearing assembly, inasmuch as when the housing 14 for the connector rod is lifted upwardly by the drill pipe string and motor assembly, the downward thrust of the drive shaft is supported upon the bearing assembly 36 and the lower bearing assembly 32 is unloaded. This adjustable lock nut means 34 is incorporated with a cap member **36*a* having a skirt 36*b* internally threaded and connected to the upper threaded end 37 of the drive shaft 18. This cap 36*a* also has an upper internally threaded bore 38 which receives the threaded lower end 39 of the lower universal joint structure 17. Provided in the cap 36*a* are the radial ports 21 which establish communication between the connecting rod housing 14 and the interior passage 22 of the drive shaft, leading to the bit structure B, whereby motor fluid supplied downwardly through the drill pipe string P, and passing through the motor stator 11, to cause revolution of the rotor 12**, flows from the housing, downwardly through the drive shaft, exiting through the usual bit orifices into the bore hole to flush cuttings therefrom. The restriction to the flow of drilling fluid caused by the bit orifices causes the existence of a differential pressure of the fluid in the connecting rod housing and the fluid in the annulus outside of the drilling structure which is a function of the pressure drop through the bit orifices, as is well known.

This differential pressure also causes the flow of a certain amount of the drilling fluid through the bearing assembly, between the bearing housing 23 and the drive shaft 18. Thus, within the structure, between the drive shaft 18 and the bearing housing 23, is flow restricting means which limits the amount of drilling fluid flow through the bearing structure to a relatively small volume, as compared with the volume flowing through the drive shaft. This flow restricting means, in the embodiment shown in FIGS. **2*a* and 2*b*, is a compound structure including an elongated tubular sleeve 41. This sleeve 41 is of suitable wear or abrasion resistant material and has an inner peripheral form or configuration which provides an annular space or one or more flow passages 42, for the flow of drilling fluid downwardly between the drive shaft 18 and the inside diameter of the sleeve 41. This sleeve 41 is located between a washer 43, which seats against a downwardly facing internal housing shoulder 44, above which is a primary flow restrictor sleeve 45 which also provides a restricted flow path 46 for the flow of drilling fluid between the drive shaft 18** and the upper end of the housing. The use of such flow restricting sleeves in bearing assemblies of the type here involved is well known and needs no further description herein.

In the preferred form now being described, and as seen in FIGS. **2*a* and 2*b*, the lower bearing means 32 comprises a lower bearing race 47 seating on the upwardly facing shoulder 30' and suitably keyed to the lower end 30 of the drive shaft 18, for rotation therewith, as by means of a suitable number of drive pins 48, carried by the bearing races 47 and extending downwardly into notches 49 provided in the shoulder 30'. An upper bearing race 50 is engaged with the downwardly facing shoulder 31 and pinned, as by pins 51, to the outer bearing housing 23. The lower race 47 fits about the drive shaft 18 on the cylindrical outer surface 47' thereon, while the upper bearing race 50 engages the inner cylindrical wall 50' of the bearing housing. The bearing elements are in the form of balls 52 riding in a lower, annular raceway 53 and an upper, annular raceway 54, in the respective lower and upper bearing races, these raceways being partly spherical in cross-section to conform with the diameter of the balls, so that the bearing assembly 32** not only can transmit thrust but also can function as a radial bearing.

In such a construction, wherein the lower bearing is both a radial and a thrust bearing, it is apparent that the primary function of the sleeves 41 and 45, described above, is to restrict the flow of fluid from the connecting rod housing through the bearing assembly and into the well bore annulus. However, if desired, these sleeves may be constructed to function as more particularly illustrated and described in the above-identified U.S. Pat. No. 4,029,368, and may be provided with suitable wear resistant elements, so that the sleeves also function as radial support bearings.

The pick-up bearing means 36 comprises a lower annular race 55 engaging the upper end 33 of the bearing housing and pinned thereto, as by means of pins 56 engaged therebetween. The upper bearing race 57 floats between the downwardly facing surface 35 of the adjustable block nut assembly 34 and the bearing balls 58, these balls 58 being engaged in a lower annular raceway 59 and the lower race 55 and an upper annular raceway 60 in the upper race 57.

Figure 5:
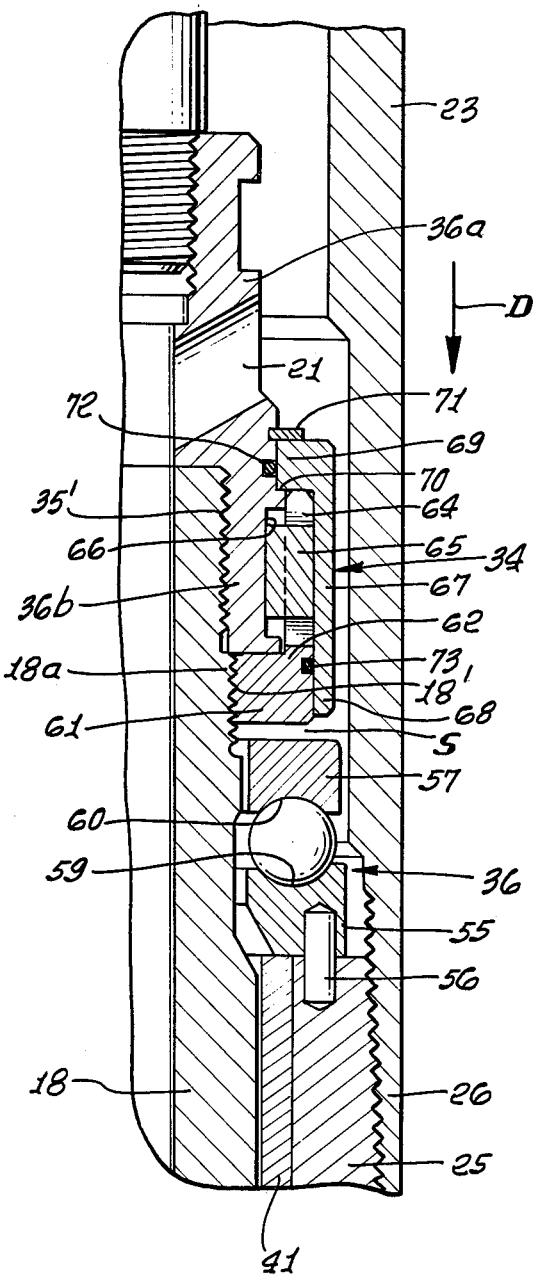
FIG. 5 is a fragmentary longitudinal section, on an enlarged scale, illustrating the adjustable lock nut in an initial adjusted position and providing clearance for the pick-up bearing.
Figure 6:
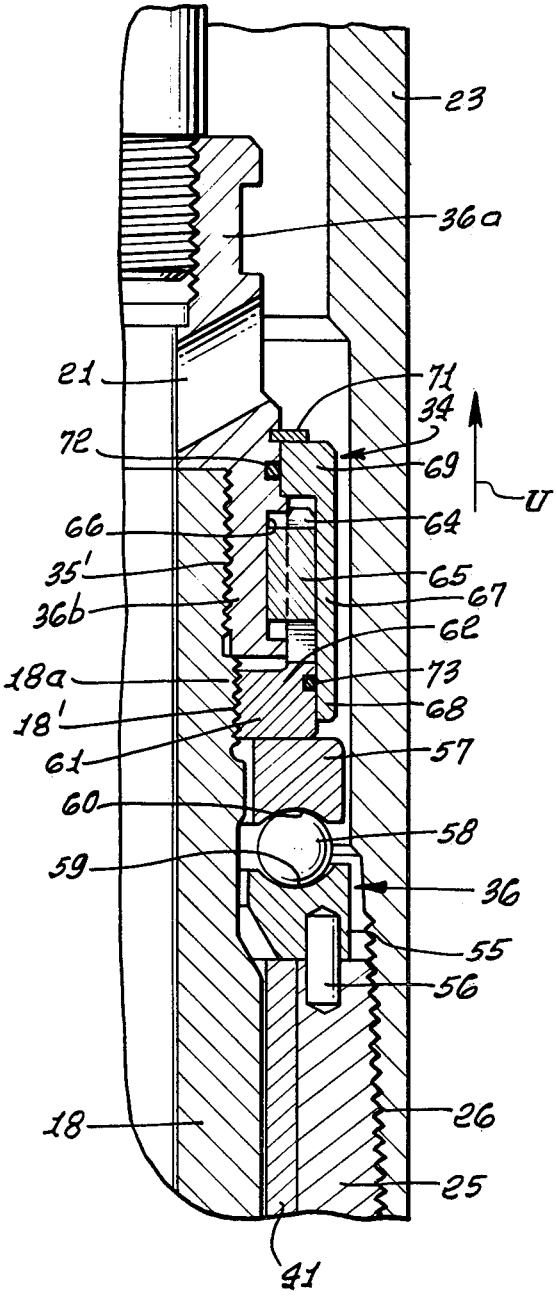
FIG. 6 is a view corresponding to FIG. 5, but showing the adjustable lock nut in an adjusted position, following wear of the pick-up bearings.
Figure 7A:
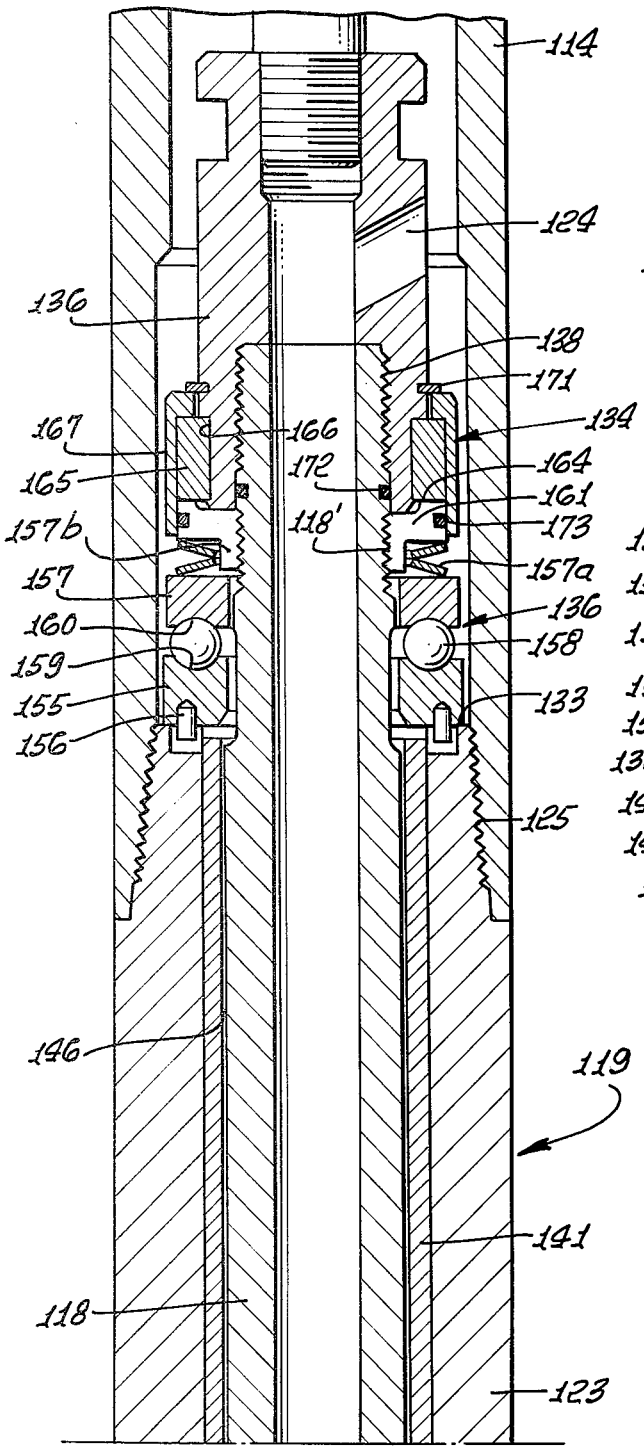
Figure 7B:
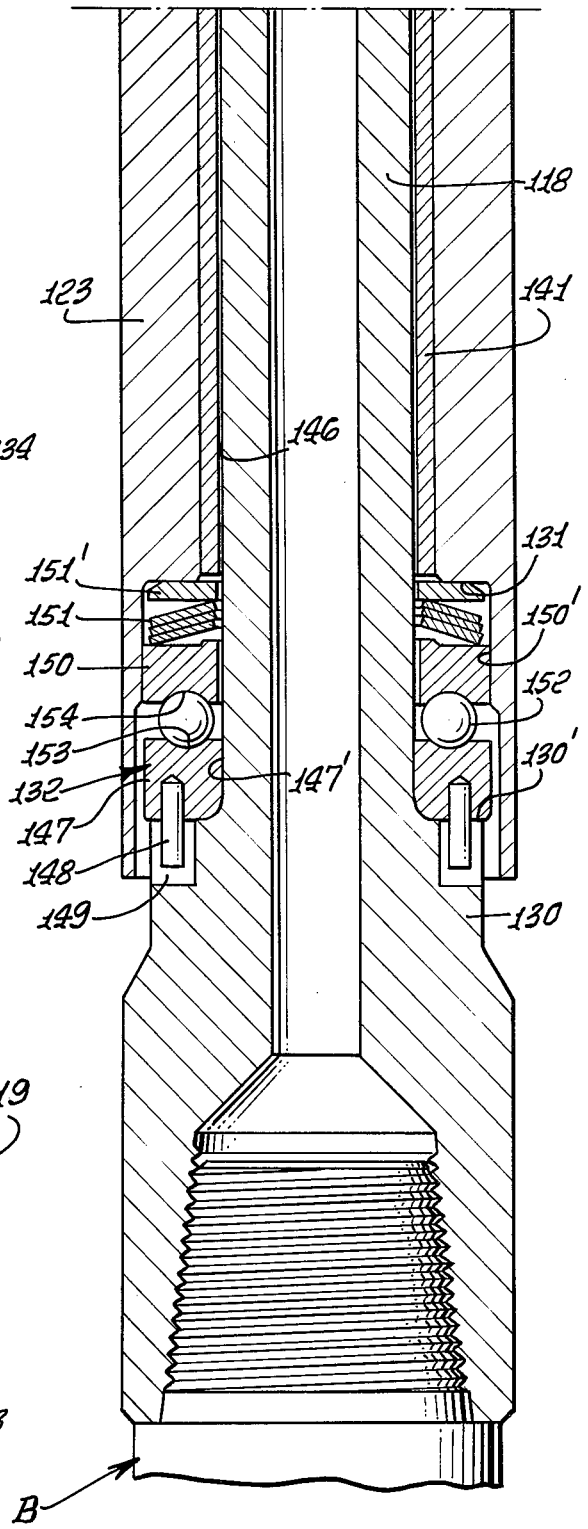

The details of the lock nut structure 34 are illustrated to best advantage in FIGS. 5 and 6. In FIG. 5, the structure is shown in a condition during which thrust is being transmitted from the bearing housing 23 in the direction of the arrow D, so that a space or gap S exists between the lower end surface of the lock nut structure and the upper pick-up bearing race 57. Thus, the pick-up bearing assembly 36 is unloaded during the drilling operation and is subject to less wear than would occur if the bearing were caused to revolve in the drilling fluid while under load. In FIG. 6, the structure is shown in a partially adjusted condition, whereby wear in the bearing balls 58 and the races has been compensated for by downward adjustment of the lower surface of the lock nut structure, and as shown by the arrow U thrust is transmitted through the bearings 58 in an upward direction, as would occur while the bit B is off of the bottom of the hole, and drilling fluid is being circulated, causing a downward force on the drive shaft due to the piston effect. Under these circumstances, pick-up bearing means 36 is under load and the lower set-down bearing means 32 would then be unloaded.

Figure 3:
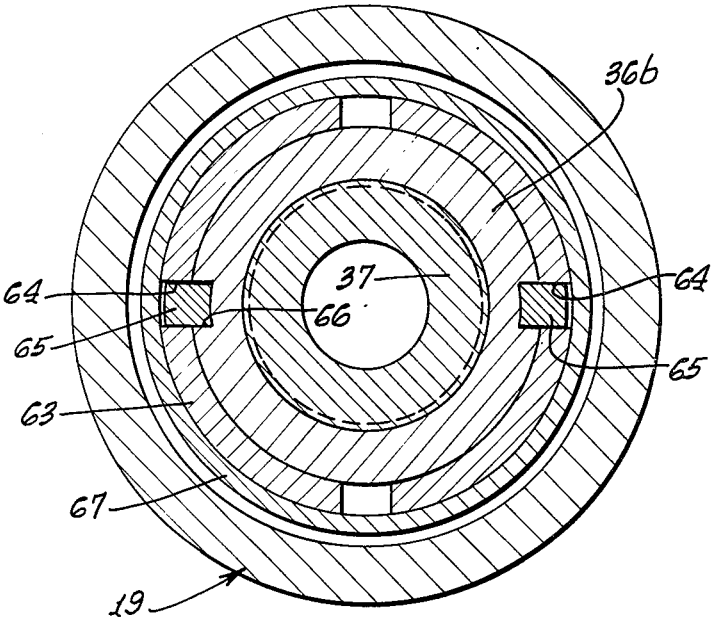
FIG. 3 is an enlarged transverse section as taken on the line 3—3 of FIG. *2a;*
Figure 4:
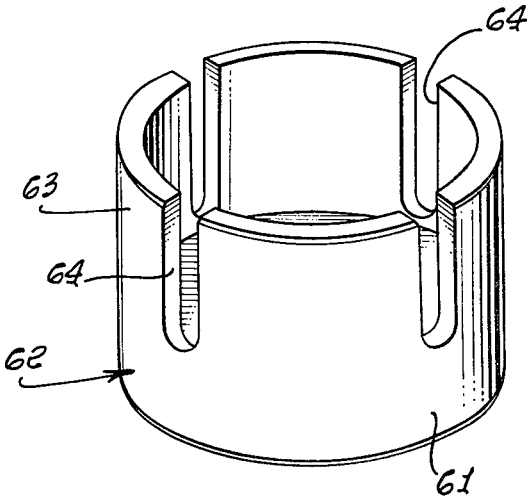
FIG. 4 is a perspective illustrating the adjustable ring member in one preferred form.
Figure 2A:
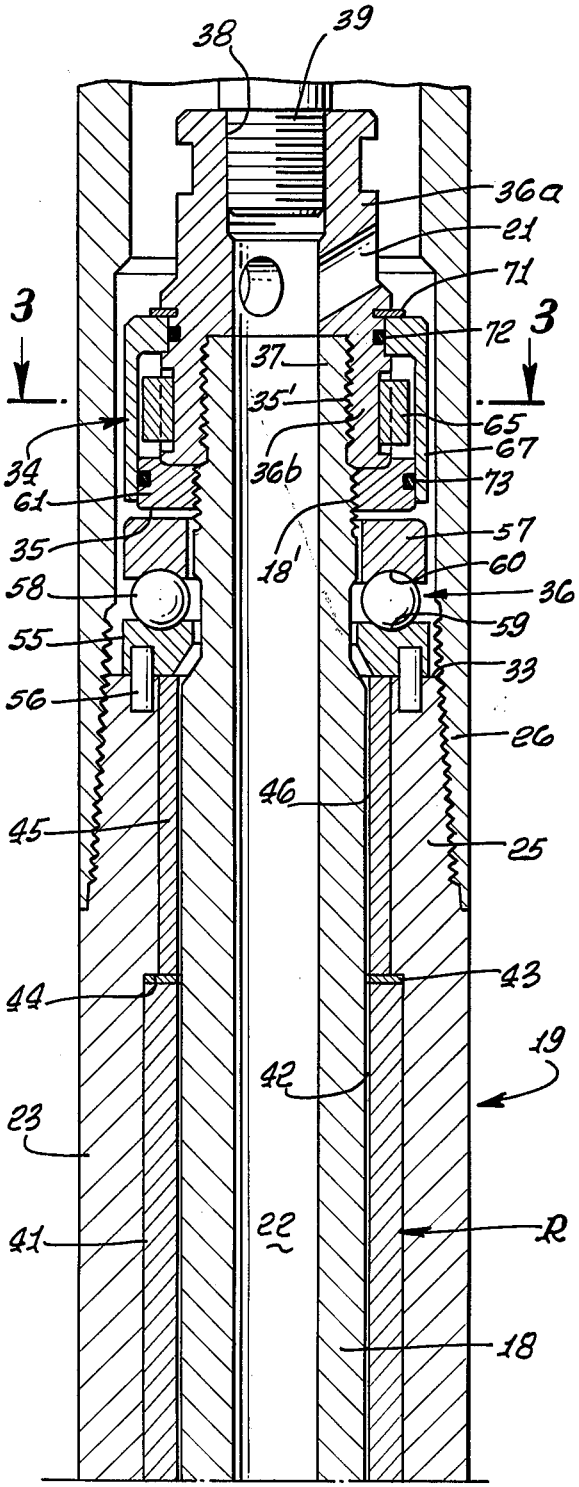
Figure 2B:
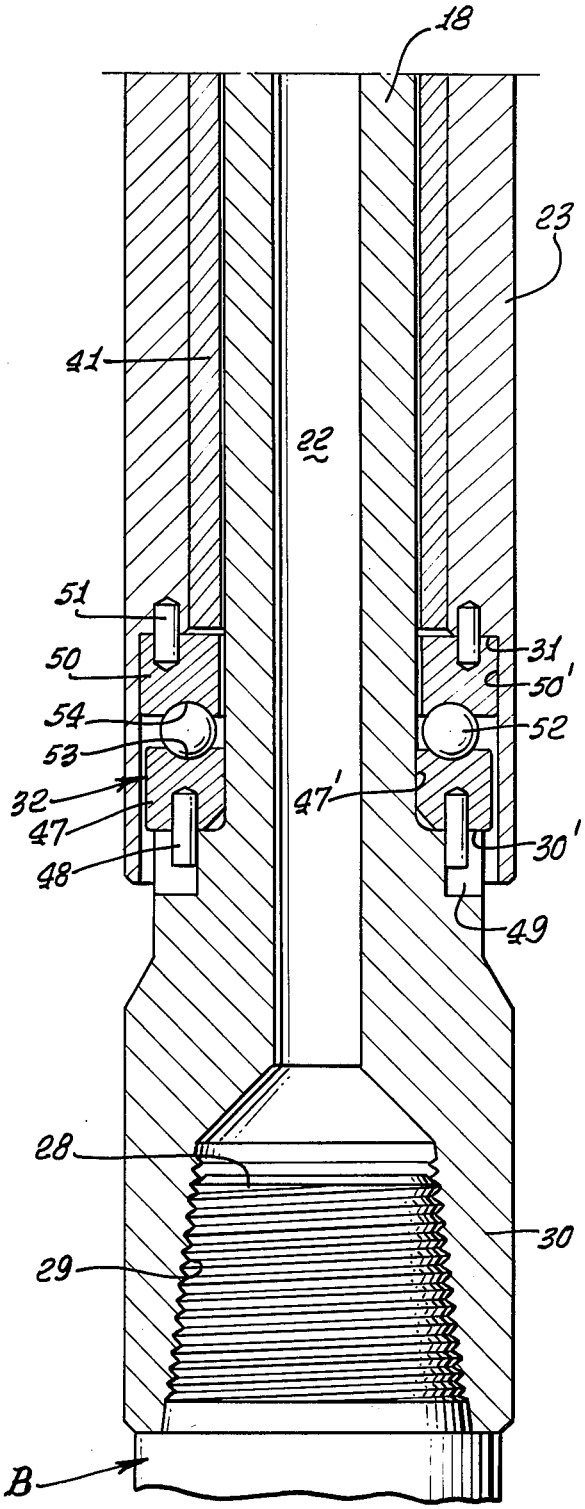

In the form now being described the cap **36*a*, as previously indicated, has a threaded skirt 36*b* engaged on the upper end of the drive shaft 18 by the thread 35' which is a right-hand thread. Below the right hand thread 35' is an enlarged drive shaft section 18*a* having a left hand thread 18' with a pitch differing from the pitch of thread 35' thereon, engaged by the internal companion thread of the lower body or ring section 61 of an annular lock nut member 62. The ring body 61 can be installed downwardly over the upper thread 35', before installation of the cap 36*a* and located in a position longitudinally of the shaft 18 affording a desired clearance space S when the entire bearing package has been assembled. Projecting upwardly from the ring 61 is an annular section 63 having, as seen in FIGS. 3 and 4, a suitable number of circumferentially spaced and longitudinally extended key slots 64. Keys 65 are disposed in a pair of opposed key slots 64 in the ring 61 and in keyways 66 extended longitudinally and disposed in diametrically spaced relation in the skirt 36***a* of the cap 36*a*. A key retaining sleeve 67 has a cylindrical body section 68 adapted to be installed over the lock nut ring 61 to confine the keys 65 in position in the key slot 66. The retainer sleeve 67 has an upper flange 69 which shoulders against an upwardly facing shoulder 70 on the cap 36*a* and is retained in place by a suitable snap ring 71 engaged in a circumferentially extended groove in the cap and projecting outwardly above the retainer sleeve flange 69.

Preferably, an upper sealing ring 72 is disposed between the flange 69 and the cap 36 above the keys 65, and a lower slide ring seal 73 is disposed between the lock nut body section 61 and the lower end of the retainer sleeve 68, acting as vibration dampeners, preventing fretting of sleeve 67 against shoulder 70 and against locknut 61. Lubrication of the keys by a quantity of grease beteeen rings 72 and 73, to facilitate removal thereof when adjustment is to be made, is another advantage.

Adjustment is made by removing the lock ring 71, to enable upward removal of the retainer sleeve 67, at which time the keys 65 can be removed from the companion keyways in the nut section 63 and in the cap to enable threaded rotation of the nut ring 61 on the thread 18' a suitable angular distance to shift the lower surface of the lock nut ring 61 downwardly, thereby reducing the space S, when the drill is operating as shown in FIG. 5, to a distance which prevents substantial separation of the upper and lower bearing races with respect to the worn bearing balls 58. Such adjustment also limits the extent of axial separation of the set-down bearing means 32, when the bit is picked up off bottom by the pick-up bearing means 34, as shown in FIG. 6.

Referring to FIGS. *7a* and *7b* another form of the invention is illustrated, wherein the bearing assemblies are provided with spring means which function as will be described below.

In this form, the elongated, tubular drive shaft 118 is rotatably supported in the outer housing structure 119, including the bearing housing 123 and the connecting rod housing 114, which are interconnected at the upper end of the bearing housing by the threaded connection 125. The structure includes adjustable lock nut means 134 above the upper pick-up bearing means 136, and the set-down bearing means 132 are located between the upwardly facing shoulder 130' on the enlarged lower end 130 of the drive shaft and the downwardly facing shoulder 131 within the lower end of the bearing housing 123. Here again, the pick-up bearing means 136 is located between the upwardly facing end 133 of the bearing housing and the downwardly facing under surface provided by the adjustable lock nut structure 134.

The flow restricter means 141, in this form consists of a single sleeve of wear or abrasion resistant material, adapted to provide a restricted flow path 146 between the drive shaft and the sleeve 141, whereby to reduce the flow of drilling fluid downwardly through the bearing assembly and to cause the majority of the drilling fluid to enter the ports 124 in the cap 136 which connects the connecting rod structure to the upper end of the drive shaft.

In this form, the lower bearing race 147 seats upon the upwardly facing shoulder 130' and is keyed or pinned thereto, as by means of pins 148 which extend from the bearing race into the notches 149 provided in the enlarged lower end of the drive shaft. This lower bearing race is engaged at its inner periphery with the outer cylindrical wall 147' of the drive shaft, and the upper bearing race 150 is engaged with the inner cylindrical wall 150' of the outer housing, so that the bearing balls 152, which engage in the lower annular race 153 and the upper annular race 154, in the respective lower and upper bearing races, effectively constitute combined radial and thrust bearings.

Interposed between the downwardly facing housing shoulder 131 and the upper bearing race 150 is one or more Belleville springs or washers 151 and an annular seating ring 151'. The Belleville springs or washers are, in the illustrated embodiment, nested and can be of a suitable number to provide a desired spring action between the housing and the drive shaft, when set-down weight is being applied to the bit by the application of weight from the drill string, through the housing to the bit. These springs 151 also function when the bit is elevated from the bottom of the hole and the drive shaft is suspended on the pick-up bearing assembly 136, to maintain a spring bias on the upper bearing race 150, maintaining it in engagement with the balls 152 and consequently the balls 152 in engagement with the lower race 147, so that during the circulating of fluid, with the bit off bottom, the respective races and balls cannot, in response to vibrations and vertical accelerations imparted by the rotation the drill bit, jump or vibrate and cause accelerated wear or deterioration of the bearing races or the bearing balls.

The pick-up bearing means 136, in this form, as seen in FIG. *7a*, includes the lower bearing race 155 which is suitably keyed or pinned to the upper end 133 of the bearing housing 125, by means of pins or keys 156 engaged between the bearing race 155 and the housing 125. The upper bearing race 157 engages the bearing balls 158, so that the balls ride in annular, partly spherical lower raceways 159 in the lower race 155 and 160 in the upper race 157. Between the lower end surface of the adjustable lock nut structure 134 and the upper end of the upper bearing race 157, in what constitutes a free space in the embodiment shown in FIG. *2a*, there is disposed one or a plurality of Belleville springs or washers 157*a*. In the form shown, a pair of such Belleville springs or washers are disposed with their inner peripheries in engagement with one another and with their outer peripheries respectively in engagement with the upper surface of the upper bearing race 157 and the lower surface of the adjustable lock nut structure.

A somewhat modified lock nut construction is illustrated in the embodiment of FIG. *7a*, in that the left hand thread 138 which connects the cap 136 to the upper end of the drive shaft 118 and the right hand thread 118' which connects the lock nut member 161 to the drive shaft are on the same diameter. However, in this form, the lock nut member 161 is formed as a diametrically split ring, providing between its halves and in each half a suitable number of circumferentially spaced and longitudinally extended key slots 164 adapted to receive the keys 165, in diametrically spaced relation, such keys also engaging in key slots 166 formed within the skirt portion of the cap 136, whereby the split lock nut member 161 and the cap are interlocked against relative rotation, by virtue of the opposite hand threads 138 and 118' with different pitches.

Here again, the keys 165 are retained in place by a retainer sleeve 167 having an upper end flange which is disposed about the outer periphery of the skirt of the cap 136 and retained in place by an appropriate lock ring 171. Also, an internal side ring seal 172 is provided between the cap 136 and the drive shaft, and an external side ring seal 173 is provided between the retainer sleeve 167 and the lock nut 161, whereby vibratory fretting between 167, 161 and 165 is prevented.

The split lock ring can be axially adjusted with respect to the drive shaft to take up clearance between the lock nut member 161 and the upper bearing race 157, as wear occurs, and to again apply a resilient compressive force to the Belleville springs 157*a*, whereby the pick-up bearing means 136 is prevented from relative axial movement between the respective bearing races and bearing balls, during the use of the tool in the drilling operation, when the pick-up bearing means 136 is unloaded except for the preload of the springs 157*a*.

From the foregoing, it is apparent that the provision of the lower Belleville springs 151 and/or upper Belleville springs 157*a* provides a spring loaded structure in which the bearings can be somewhat loaded during operation in either a drilling condition, in which the thrust is being transmitted through the Belleville springs 151 to the bit, or in a circulating condition in which the bearings 132 are relieved of the drilling load, but the weight of the drive shaft and the force applied thereto by the piston effect caused by drilling fluid circulating through the bit, is supported on the pick up bearing means 136.

While single pick-up bearing and set-down bearing assemblies have been illustrated in the preferred embodiments herein illustrated, it will also be understood that the bearings may be made up of a plurality of stacked bearings, and that the location of the flow restricting means between the axially spaced set-down and pick-up bearing means provides not only thrust bearing capability, but also provides radial bearing capability to assist in preserving the flow restrictor means against initial radial contact, at least until such time as the set-down bearings and pick-up bearings have worn to the point that they are incapable of preventing radial contact between the drive shaft and the flow restrictor means. In the event that such significant wear occurs, then the flow restrictor means, whether or not provided with wear resistant inserts, take the radial load.

I claim:

1. A bearing assembly for use with an inhole fluid motor having a stator and a rotor, said bearing assembly comprising an elongated, outer housing connectable at one end to said stator; a drive shaft in said housing connectable at one end to said rotor and projecting at its other end from the other end of said housing; first thrust bearing means on said drive shaft and said housing for transmitting thrust from said housing to said drive shaft in one direction; second thrust bearing means on said drive shaft and said housing adjacent said one end of said drive shaft for transmitting thrust from said housing to said drive shaft in the other direction; and stop means on said drive shaft spaced from said second bearing means to enable limited longitudinal movement of said housing relative to said drive shaft to load and unload said bearing means when thrust is transmitted in opposite directions between said housing and said drive shaft; said stop means including a connector cap on said drive shaft connectable with said rotor and having a fluid inlet from said stator to said drive shaft; said drive shaft having a fluid passage leading from said inlet to said other end of said drive shaft; and means for adjusting the position of said stop means towards said second bearing means to reduce the space between said stop means and said second bearing means and compensate for wear of said first and second bearing means.

2. A bearing assembly as defined in claim 1; and further including spring means in one of said first and second bearing means for resiliently loading said second bearing means when thrust is transmitted through said first bearing means.

3. A bearing assembly as defined in claim 1; and adjustable lock means for locking said cap on said drive shaft.

4. A bearing assembly as defined in claim 1; including flow restrictor means between said shaft and said housing intermediate said first and second bearing means.

5. A bearing assembly as defined in claim 1; at least one of said bearing means being radial and thrust bearing means.

6. A bearing assembly as defined in claim 1; at least one of said bearing means being radial and thrust bearing means, and including flow restrictor means between said shaft and said housing intermediate said first and second bearing means.

7. A bearing assembly as defined in claim 1; and further including spring means incorporated in each of said first and second bearing means and resiliently loading said bearing means.

8. A bearing assembly as defined in claim 1; adjustable lock means for locking said cap on said drive shaft; said adjustable lock means including a threaded connection of one hand between said cap and said drive shaft; a member having said stop means thereon and a threaded connection of the other hand with said drive shaft, and means interlocking said cap and said member.

9. A bearing assembly as defined in claim 1; said adjustable lock means including a threaded connection of one hand between said cap and said drive shaft; a member having said stop means thereon and a threaded connection of the other hand with said drive shaft, and said drive shaft having a first threaded section receiving said cap and a second threaded section receiving said member; said second threaded section being of a larger diameter than said first threaded section; and said member being a ring threaded on said second threaded section.

10. A bearing assembly as defined in claim 1; adjustable lock means for locking said cap on said drive shaft; said adjustable lock means including a threaded connection of one hand between said cap and said drive shaft; a member having said stop means and a threaded connection of the other hand with said drive shaft; and said drive shaft having a first threaded section receiving said cap and a second threaded section receiving said member; said second threaded section being of a larger diameter than said first threaded section; and said member being a ring threaded on said second threaded section; said means interlocking said cap and said member being a key; said member and said cap having keyways in circumferentially spaced relation for receiving said key in selected angular positions with respect to said drive shaft.

11. A bearing assembly as defined in claim 1; adjustable lock means for locking said cap on said drive shaft; said adjustable lock means including a threaded connection of one hand between said cap and said drive shaft; a member having said stop means and a threaded connection of the other hand with said drive shaft; and said drive shaft having a first threaded section receiving said cap and a second threaded section receiving said member; said second threaded section being of a larger diameter than said first threaded section; and said member being a ring threaded on said second threaded section; said means interlocking said cap and said member being a key; said member and said cap having keyways in circumferentially spaced relation for receiving said key in selected angular positions with respect to said drive shaft; and also including means releasably securing said key in said keyways in a selected angular position of said member.

12. A bearing assembly as defined in claim 1; adjustable lock means for locking said cap on said drive shaft; said adjustable lock means including a threaded connection of one hand between said cap and said drive shaft; a member having said stop means and a threaded connection of the other hand with said drive shaft; said member being a radially split ring; and including retainer means holding said split ring in engagement with the thread on said drive shaft.

13. A bearing assembly as defined in claim 1; adjustable lock means for locking said cap on said drive shaft; said adjustable lock means including a threaded connection of one hand between said cap and said drive shaft; a member having said stop means and a threaded connection of the other hand with said drive shaft; said member being a radially split ring; and including a retainer means holding said split ring in engagement with the thread on said drive shaft; said means interlocking said cap and said member being a key; said member and said cap having keyways in circumferentially spaced relation for receiving said key in selected angular positions with respect to said drive shaft.

14. A bearing assembly as defined in claim 1; adjustable lock means for locking said cap on said drive shaft; said adjustable lock means including a threaded connection of one hand between said cap and said drive shaft; a member having said stop means and a threaded connection of the other hand with said drive shaft; said member being a radially split ring; and including retainer means holding said split ring in engagement with the thread on said drive shaft; said means interlocking said cap and said member being a key; said member and said cap having keyways in circumferentially spaced relation for receiving said key in selected angular positions with respect to said drive shaft; said retainer means releasably retaining said key in selected keyways in said cap and said member.

15. A bearing assembly as defined in claim 1; each of said bearing means including opposed races respectively carried by said housing and said drive shaft and having spherical raceways and balls freely rotatable in said raceways.

16. A bearing assembly as defined in claim 1; each of said bearing means including opposed races respectively carried by said housing and said drive shaft and having spherical raceways and balls freely rotatable in said raceways, and spring means engaged between one of the faces of one of said bearing means and one of said housing and said stop means for maintaining engagement between said races and balls of said one of said bearing means while thrust is transmitted between said drive shaft and said housing by the other of said bearing means.

17. A connector for connecting a fluid motor rotor to a hollow drive shaft supported in a bearing housing, said connector comprising: a cap having means for connection to said rotor and to said drive shaft; a fluid passage in said cap leading between the exterior and the interior thereof; a keyway in said cap; a key in said keyway; a locking member having a number of circumferentially spaced keyways selectively engageable with said key; retainer means holding said key in said drive shaft; and means for adjustably positioning said locking member on said drive shaft.

18. A connector cap as defined in claim 17, said locking member and said cap having a thread of opposite hand for connection with said drive shaft.

19. In-hole motor apparatus comprising: a fluid driven motor having a stator and a rotor; a bearing assembly having a housing connected with said stator and a drive shaft; a connection between said rotor and said drive shaft, a thrust transfer shoulder on said connection; said housing having a shoulder spaced from said thrust transfer shoulder, means for transmitting thrust in opposite directions between said housing and said drive shaft including a thrust bearing incorporated between said shoulders, said thrust transfer shoulder being spaced from said bearing when thrust is transmitted from said housing to said drive shaft; means for adjusting said thrust transfer shoulder longitudinally of said shaft so that the space between said thrust bearing and said thrust transfer shoulder is adjustably located in position for thrust transfer from said housing to said drive shaft.

20. In-hole motor apparatus comprising: a fluid driven motor having a stator and a rotor; a bearing assembly having a housing receiving motor fluid from said stator; a hollow drive shaft in said housing; a coupling between said rotor and said drive shaft having a passage between said housing and said hollow drive shaft; thrust bearing means between said housing and said hollow drive shaft for thrust transmission in opposite directions; said thrust bearing means including a shoulder on said housing spaced longitudinally from said coupling; a member locked on said hollow drive shaft by said coupling and providing a thrust shoulder on said hollow drive shaft; a thrust bearing between said shoulders; said member being adjustable relative to said shoulder on said housing to provide a predetermined space between said shoulder enabling said last mentioned thrust bearing to be free of thrust load when said housing applies thrust to said drive shaft through said thrust bearing means in one direction and to transmit thrust from said housing to said shaft in the other direction.

21. In-hole motor apparatus comprising: a fluid driven motor having a stator and a rotor; a bearing assembly having a housing connected with said stator and a drive shaft; a connection between said rotor and said drive shaft; said housing having a shoulder spaced from said connection; thrust bearings between said shoulder and said connection; said connection including a cap threaded on said shaft by a thread of one hand; a thrust member threaded on said shaft by a thread of the other hand for adjustment towards said shoulder; and a key locking said thrust member and said cap against relative rotation.

* * * * *